United States Patent [19]

Babuka et al.

[11] Patent Number: 4,480,884

[45] Date of Patent: Nov. 6, 1984

[54] ZERO INSERTION FORCE CONNECTOR AND CIRCUIT CARD ASSEMBLY

[75] Inventors: Robert Babuka, Vestal; Andrea Burke, Endicott, both of N.Y.; Paul E. Haiges, Jr., Brackney, Pa.

[73] Assignee: International Business Machines Corporation, Armonk, N.Y.

[21] Appl. No.: 510,041

[22] Filed: Jul. 1, 1983

[51] Int. Cl.[3] ..... H01R 9/09

[52] U.S. Cl. ..... 339/17 L; 339/75 MP; 339/176 MP; 339/186 M

[58] Field of Search ..... 339/17 L, 75 MP, 176 MP, 339/186 R, 186 M

[56] References Cited

U.S. PATENT DOCUMENTS

| | | | |
|---|---|---|---|
| 3,184,707 | 5/1965 | Anderson | 339/186 M |
| 3,944,311 | 3/1976 | Sprenkle et al. | 339/75 MP |
| 3,970,353 | 7/1976 | Kaufman | 339/176 MP |
| 4,196,955 | 4/1980 | Anhalt | 339/74 R |

FOREIGN PATENT DOCUMENTS

| | | | |
|---|---|---|---|
| 1234816 | 2/1967 | Fed. Rep. of Germany | 339/75 MP |
| 3015139 | 10/1981 | Fed. Rep. of Germany | 339/186 R |

OTHER PUBLICATIONS

"Twin-Contact Connector", J. A. Colletti, et al., IBM Technical Disclosure Bulletin, vol. 14, No. 9, Feb. 1972, pp. 2597–2598.

*Primary Examiner*—John McQuade
*Attorney, Agent, or Firm*—John H. Bouchard

[57] ABSTRACT

A zero insertion force connector and printed circuit card retention and polarization arrangement wherein the card has circuit tabs along one edge and the connector has spring contacts which engage the tabs with a wiping action when they are closed. A pin is provided at one end of the connector and a pin slot at the opposite end. A pin slot is provided at one end of the card and a pin at the opposite end, the pin and pin slot in the connector and pin slot and pin in the card being arranged to respectively come into engagement when the card is inserted into the connector to prevent movement of the card when the connector spring contacts are closed.

4 Claims, 9 Drawing Figures

ZERO INSERTION FORCE CONNECTOR AND CIRCUIT CARD ASSEMBLY

BACKGROUND OF THE INVENTION

It is well known in the electronic computer art that a computer system includes at least one printed circuit board having printed circuitry, signal planes, voltage planes, ground planes and plated through holes. The board is electrically connected to the computer by distribution cables which transmit input-output signal information. In many applications, a plurality of printed circuit cards are connected to the board. These cards contain printed circuitry and electronic components and serve as the heart and brain of a computer system. Each card has on both sides along one edge one or more rows of circuit tabs and may, if desired, have a similar arrangement of tabs along the opposite edge. Various types of edge connectors may be used to connect the cards to the circuit board. A preferred type of connector is a zero insertion force connector which permits easy insertion and removal of a card with no resulting damage and contacts the card tabs with a wiping action to make a good electrical contact. The connector plugs into the plated through holes in the circuit board and has opposing rows of flexible spring contacts which are cammed into an open position or a closed position. When cammed to the open position, the circuit card may be inserted or removed in either a horizontal or vertical direction. When the card is inserted, the spring contacts are cammed to the closed position and will engage the card tabs with a vertical wiping action.

However, it was found that sometimes the force of the wiping action of the spring contacts will cause the card to move, resulting in contact misregistration and loss of wiping. Also, if the card is inserted improperly, the contact fingers will not contact the right card tabs, resulting in electrical shorts, etc. It became evident that retention means and polarization means were needed to prevent the card from moving and to insure that it is inserted correctly.

OBJECTS AND SUMMARY OF THE INVENTION

The present invention makes use of a coacting pin and slot arrangement on the circuit card and on the zero insertion force connector. A pin is provided at one end of the connector and a pin slot at the opposite end. A pin is also provided at one of the card and a pin slot at the opposite end. The pin and pin slot in the card and the pin and pin slot in the connector are arranged to respectively come into engagement when the card is inserted into the connector, to prevent movement of the card in a horizontal direction and a vertical direction when the connector spring contacts are closed. Polarization of the card is accomplished by the pin on the connector. If the card is improperly inserted, full insertion will be impossible because of interference with the pin on the connector.

Accordingly, a primary object of the present invention is to provide a novel and improved zero insertion force connector and circuit card assembly having circuit card retention and polarization.

A further object of the present invention is to provide a novel and improved zero insertion force connector and circuit card assembly having circuit card retention and polarization with the card being inserted either horizontally or vertically.

A still further object of the present invention is to provide a novel and improved zero insertion force connector and circuit card assembly wherein the connector is provided with a pin at one end and a pin slot at the opposite end and the card is provided with a pin at one end and a pin slot at the opposite end, the pins and pin slots respectively coming into engagement when the card is inserted into the connector.

Another object of the present invention is to provide a novel and improved zero insertion force connector and circuit card assembly wherein the connector is provided with means to prevent improper insertion of the card.

The foregoing and other objects, features and advantages of the invention will be apparent from the following more particular description of a preferred embodiment of the invention, as illustrated in the accompanying drawings.

DESCRIPTION OF THE PREFERRED EMBODIMENT

Figure 1:
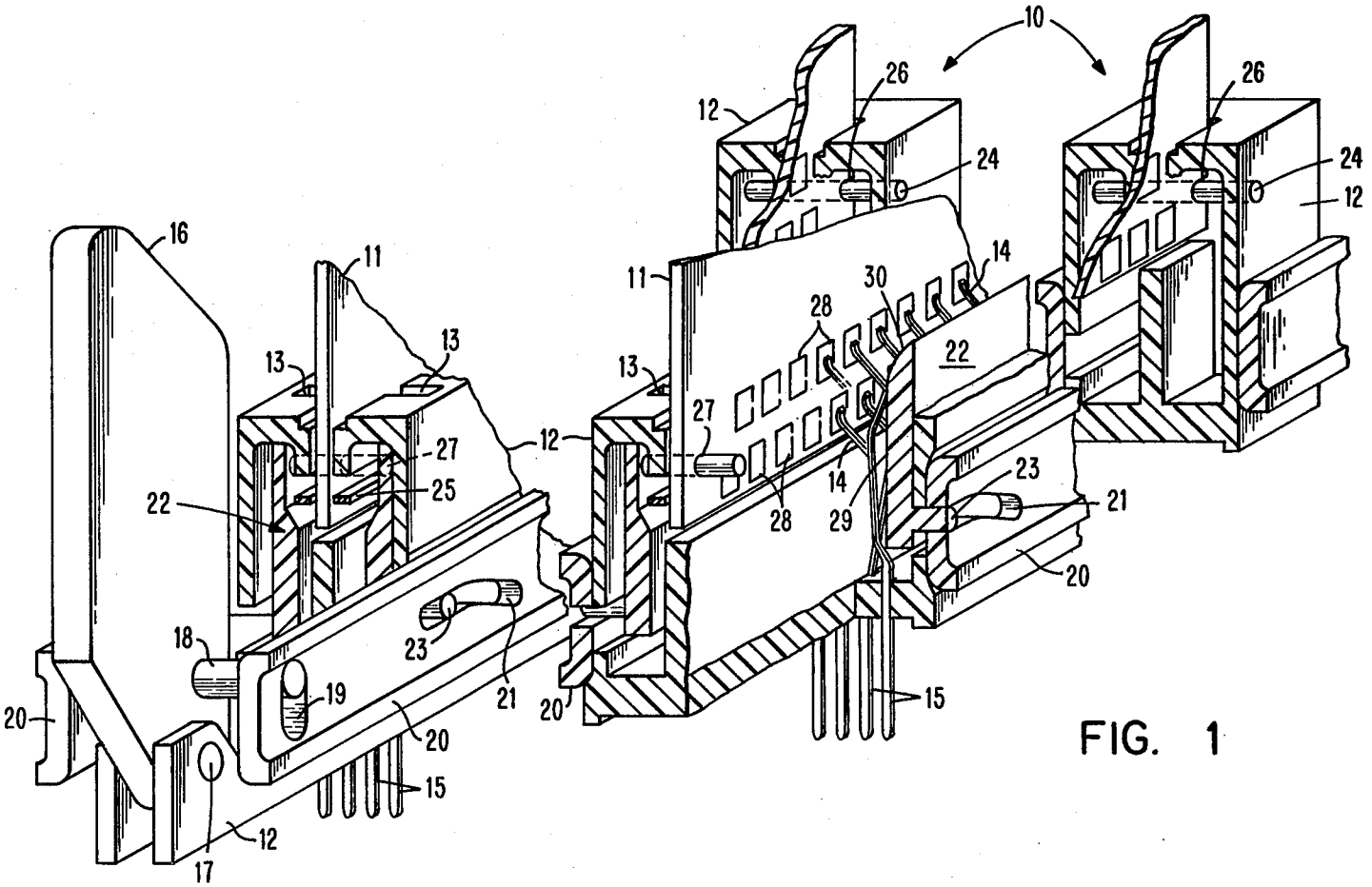
FIG. 1 is an isometric view showing portions of two adjacent zero insertion force connectors with circuit cards inserted therein in accordance with the present invention.

Referring to FIG. 1, there is shown an isometric view of portions of two adjacent zero insertion force connectors 10 with printed circuit cards 11 inserted therein in accordance with the present invention. The connectors are identical and are illustrative of one form of a zero insertion force connector adapted for use with the present invention and that other forms of zero insertion force connectors could be used just as well.

Each connector comprises a spring contact housing 12 having two opposing rows of slots 13 which house opposing rows of flexible spring contacts 14. The bottom portion of the contacts take the form of input-output pins 15 which plug into plated-through holes in a printed circuit board to form a card-on-board package. At one end of each connector is an actuator lever 16 which is pivotally mounted to the connector base by means of a pin 17. Actuator lever 16 has fixed thereto a linear drive cam pin 18 which rides in a slot 19 in a pair of linear cam members 20. A linear cam member 20 is provided on each side of the connector housing and they are slideably mounted for horizontal movement. Each linear cam member 20 has a lift ramp slot 21, and on each side of the connector housing there is a displacer member 22 having fixed thereto a pin 23 which rides in its associated lift ramp slot. The displacer members are slideably mounted for vertical movement. Fixed at one end of the connector housing is a retention pin 24 and at the opposite end there is formed a pin retention slot 25.

The printed circuit card 11 is provided at one end with a pin slot 26 and at the opposite end a pin 27 is attached. The card contains at least one row of circuit tabs 28 on both sides of the card and along one edge. The circuit tabs are arranged for coaction with the spring contacts 14 of the connector to provide an electrical connection between the printed circuits on the card and the input - output pins 15 of the connector.

As shown in FIG. 1, the printed circuit card 11 has been inserted in between the opposing rows of spring contacts in the connector and the card slot 26 is engaged with the connector pin 24 and the card pin 27 is in engagement with the connector pin slot 25. The connector is shown in the closed position with the spring contacts 14 in contact with their associated circuit tabs 28 on the card. Closure of the connector is effected by pivoting the actuator lever 16 clockwise to the upright position shown. As a result, drive pin 18 drives the linear cam member 20 on each side of the housing to the right which causes the displacer member pins 23 to move from the low end portion of their associated lift ramp slot 21 up to the upper portion of the slot. This action raises the displacer member 22 on each side of the housing, whereby the flat surface 29 thereon engages the spring contacts to flex them against their associated circuit tabs on the card with a vertical upward wiping action. The wiping action occurs due to the flexible V-shaped configuration of the ends of the spring contacts.

To open the connector, the reverse action takes place. The actuator lever 16 is pivoted counter-clockwise to a horizontal position. As a result, drive pin 18 drives the linear cam member 20 on each side of the housing to the left which causes the displacer member pins 23 to move from the high end portion of their associated lift ramp slot 21 down to the lower portion of the slot. This action lowers the displacer member 22 on each side of the housing whereby the upper curved relief surface 30 on the members allows the spring contacts to flex back out of engagement with the circuit tabs on the card. This frees the card for removal and also allows a card to be inserted with zero insertion force.

Figure 2:
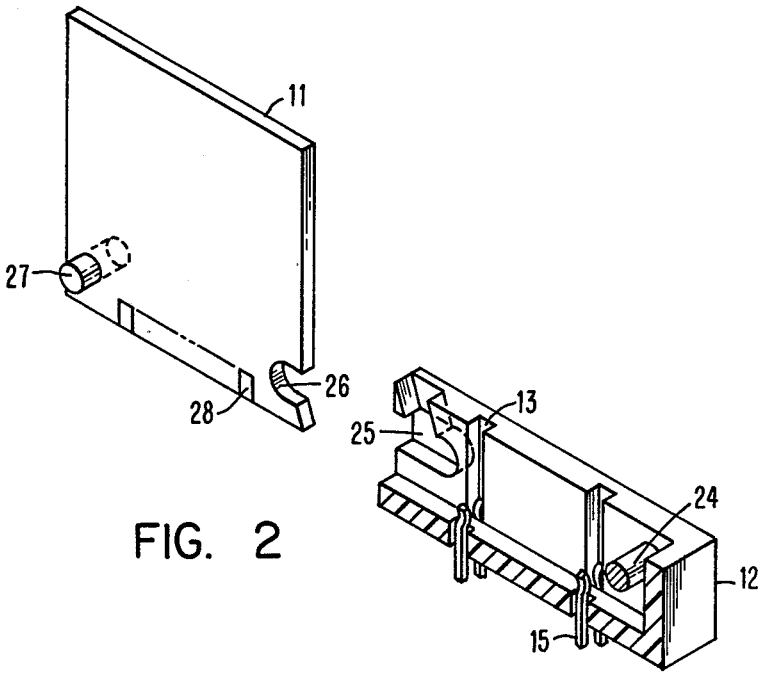
FIG. 2 is an isometric view showing the printed circuit card and a portion of the zero insertion force connector prior to a single card edge connection.

FIG. 2 is an isometric view illustrating one half of the connector housing 12 with its retention pin 24 and the retention pin slot 25. Also shown, prior to single card edge connection, is the printed circuit card 11 with its pin slot 26, pin 27, and circuit tabs 28.

Figure 3:
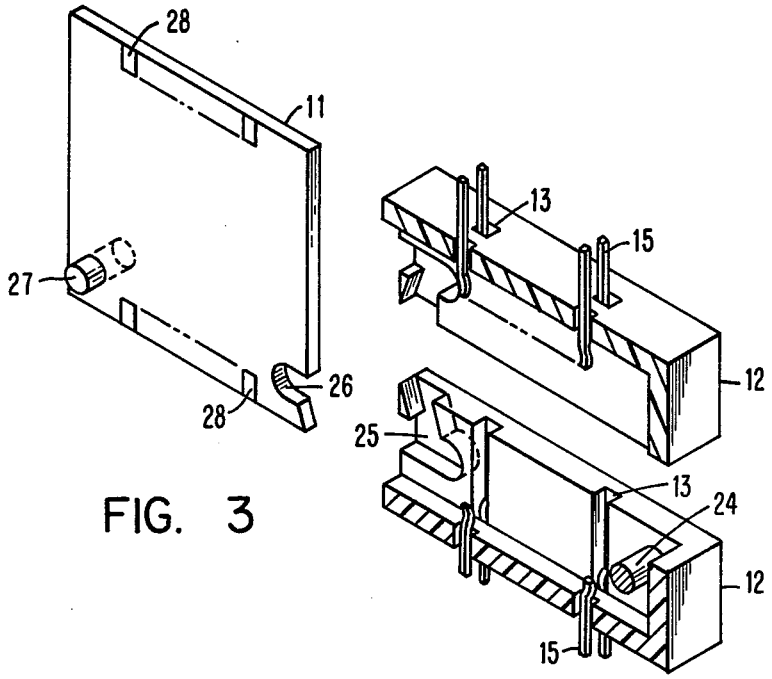
FIG. 3 is an isometric view showing the printed circuit card and a portion of the zero insertion force connector prior to a double card edge connection.

FIG. 3 is similar to FIG. 2, except that a half of two connector housings are shown and a card having circuit tabs 28 along opposite edges to illustrate a double card edge connection.

Figure 4:
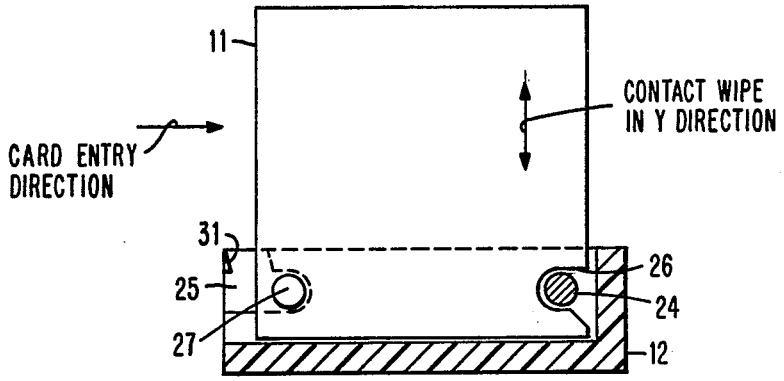
FIG. 4 is a schematic showing of the printed circuit card inserted horizontally into the zero insertion force connector for single edge connection and card retention.
Figure 5:
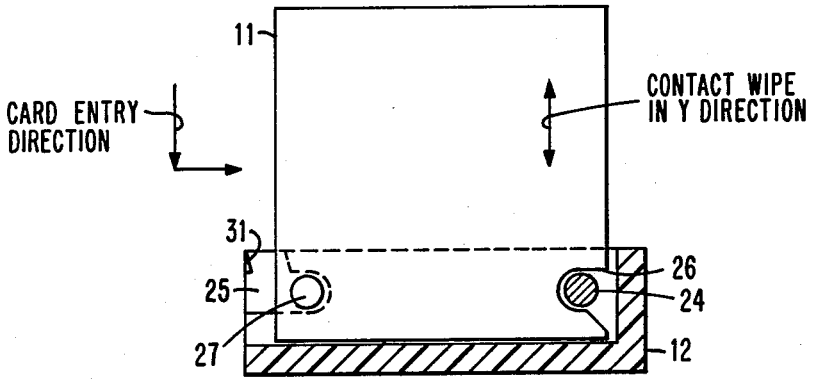
FIG. 5 is a schematic showing of the printed circuit card inserted vertically into the zero insertion force connector for single edge connection and card retention.
Figure 6:
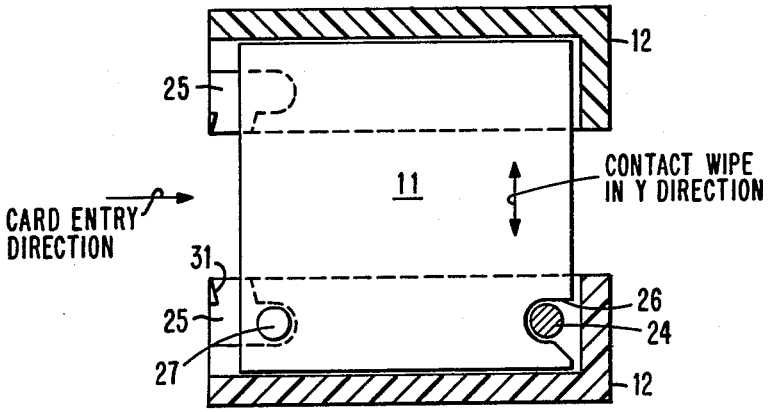
FIG. 6 is a schematic showing of the printed circuit card inserted horizontally into the zero insertion force connector for double edge connection and card retention.

FIGS. 4–6 illustrate the card retention feature of the present invention. In FIG. 4, the card is shown inserted horizontally with pin 27 on the card seated into slot 25 in the connector and pin 24 of the connector seated into the slot 26 in the card. As a result, the card is prevented from moving in a vertical direction when the spring contacts engage the circuit tabs on the card with a vertical wiping action. FIG. 5 shows the same retention feature with the card being inserted vertically. In this case, the pin 27 on the card rides down a sloping ramp portion 31 of the connector slot 25. This causes the card to shift to the right allowing pin 27 to seat in slot 25 and pin 24 to seat in slot 26. The retention feature is also shown in FIG. 6 for a double card edge connector.

Figure 7:
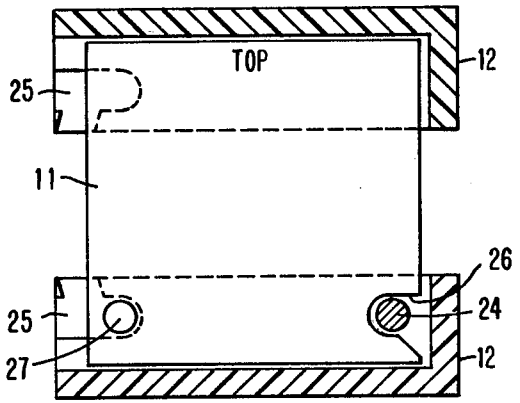
FIG. 7 is a schematic showing of the printed circuit card properly inserted horizontally into the zero insertion force connector for double edge connection and card retention.
Figure 9:
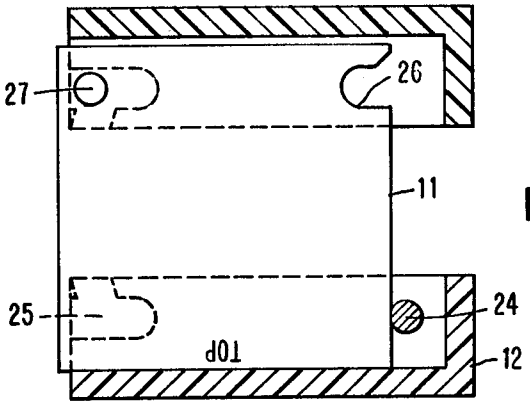
FIG. 9 is a schematic showing the flipped card of FIG. 8 improperly inserted into the zero insertion force connector.
Figure 8:
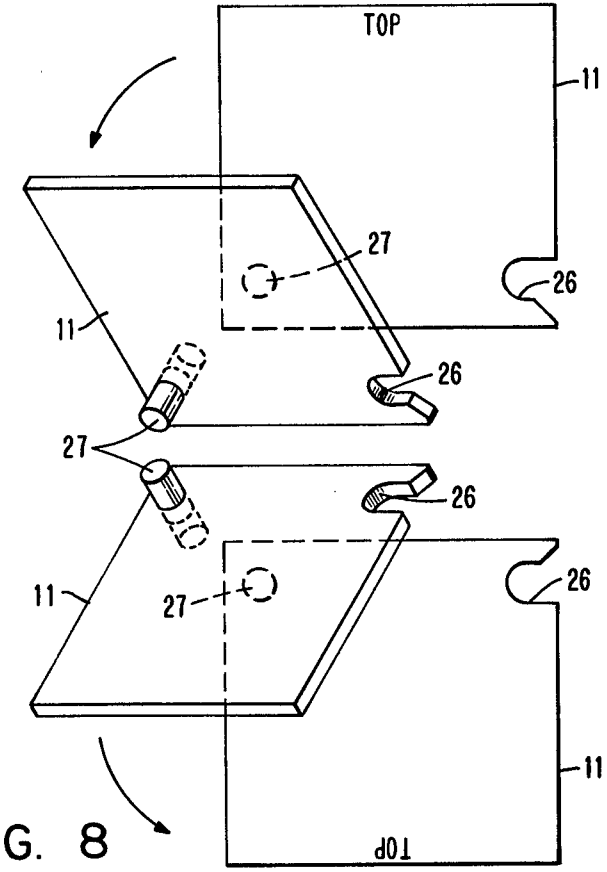
FIG. 8 is a schematic showing of the printed circuit card flipped over to an improper inserting position.

FIGS. 7–9 illustrate the polarization feature of the present invention. FIG. 7 shows a card properly inserted and retained as previously described. FIG. 8 shows a card flipped over from a proper insertion position to an improper insertion position, and FIG. 9 shows the flipped card of FIG. 8 improperly inserted into the double card edge connector; and it will be noted that the card cannot be fully and properly inserted because the leading edge of the card will abut against the connector retention pin 24 which results in improper alignment of the circuit tabs on the card with the spring contacts. The same condition will occur if the card is rotated in the same plane from its proper insertion position. Thus, the polarization feature insures that an improperly positioned card cannot be fully inserted into the connector.

While the invention has been particularly shown and described with reference to a preferred embodiment thereof, it will be understood by those skilled in the art that various changes in form and detail may be made therein without departing from the spirit and scope of the invention.

What is claimed:

1. A connector-card retention and polarization device comprising:

a printed circuit card having a row of circuit tabs along one edge;

a zero insertion force connector having opposing rows of flexible spring contacts;

means for opening and closing said contacts to allow for zero insertion force positioning of said card in between said contacts when they are open and to cause said contacts to engage the circuit tabs on the card with a wiping action when they are closed;

a pin at one end of said connector and a pin slot at the opposite end; and a pin slot at one end of said card and a card pin at the opposite end, the pin and pin slot in said connector and pin slot and pin in said card being arranged to respectively come into engagement when said card is inserted into the connector to prevent movement of the card when the connector spring contacts are closed.

2. A connector-card retention and polarization device as defined in claim 1 wherein said pin slot in the connector is configured to allow for either horizontal or vertical insertion of the card into the connector.

3. A connector-card retention and polarization device as defined in claim 1 wherein said wiping action of the spring contacts is in a vertical direction when they are closed and said card and connector pin and pin slot arrangement prevents vertical movement of the card during closure of said contacts.

4. A connector-card retention and polarization device as defined in claim 1 wherein said card and connector pin and pin slot arrangement prevents complete insertion of the card into said connector if the card is flipped over or rotated from its normal position of insertion.

* * * * *